US007144309B2

(12) United States Patent
Hoffman

(10) Patent No.: US 7,144,309 B2
(45) Date of Patent: Dec. 5, 2006

(54) ROTATIONAL PROCESSOR WITH DRIVE ROLLERS

(75) Inventor: Steve E. Hoffman, Englewood Cliffs, NJ (US)

(73) Assignee: Mikronite Technologies Group, Inc., Eatontown, NJ (US)

( * ) Notice: Subject to any disclaimer, the term of this patent is extended or adjusted under 35 U.S.C. 154(b) by 73 days.

(21) Appl. No.: 11/260,523

(22) Filed: Oct. 27, 2005

(65) Prior Publication Data

US 2006/0089091 A1 Apr. 27, 2006

Related U.S. Application Data

(60) Provisional application No. 60/622,402, filed on Oct. 27, 2004.

(51) Int. Cl.
*B24B 31/00* (2006.01)

(52) U.S. Cl. ..... 451/326; 451/328; 451/329

(58) Field of Classification Search ..... 451/32, 451/35, 326, 328, 329
See application file for complete search history.

(56) References Cited

U.S. PATENT DOCUMENTS 3,579,920 A * 5/1971 Heiberger ..... 451/329
5,355,638 A 10/1994 Hoffman
5,531,637 A * 7/1996 Kimura ..... 451/329
5,848,929 A 12/1998 Hoffman
6,599,176 B1 7/2003 Hoffman
6,666,757 B1 * 12/2003 Kim ..... 451/327
6,733,375 B1 5/2004 Hoffman
6,743,082 B1 * 6/2004 Tochishita et al. ..... 451/85
6,863,207 B1 3/2005 Hoffman

OTHER PUBLICATIONS

PCT/US03/21218, Jul. 2003, Hoffman.

* cited by examiner

*Primary Examiner*—Eileen P. Morgan
(74) *Attorney, Agent, or Firm*—Drinker Biddle & Reath LLP

(57) ABSTRACT

A rotational processor comprises an outer vessel and a plurality of inner vessels having an outer traction surface adapted for rolling contact with an inner surface of the outer vessel. A plurality of drive rollers drive the inner vessels about a center line of the outer vessel in rolling contact with the outer vessel. Each of the drive rollers contacts each of a pair of adjacently located inner vessels when the inner vessels are not being driven about the outer vessel. The outer traction surfaces compress in response to centrifugal forces applied by the rolling contact with the outer vessel such that each of the drive rollers separates from one of the adjacently located pair of the inner vessels.

16 Claims, 4 Drawing Sheets

ROTATIONAL PROCESSOR WITH DRIVE ROLLERS

CROSS-REFERENCE TO RELATED APPLICATION

This application claims priority from U.S. Provisional Application No. 60/622,402, filed Oct. 27, 2004, which is incorporated herein in its entirety.

FIELD OF THE INVENTION

The present invention relates to processing machines and, more particularly, to an improved high speed rotational processor

BACKGROUND OF THE INVENTION

Many conventional rotational processors include an outer vessel and inner vessels located within an interior of the outer vessel. The inner vessels are adapted to receive processing containers containing articles to be finished. A drive system of the rotational processor drives the inner vessels about a center line of the outer vessel in rolling contact with an inner surface of the vessel. Examples of prior rotational processors are described in U.S. Pat. Nos. 6,733,375, 5,848,929, and 5,355,638.

SUMMARY OF THE INVENTION

According to one aspect of the invention, a rotational processor comprises an outer vessel defining an inner surface and a plurality of inner vessels each defining an interior for receiving a processing container (or products directly). Each of the inner vessels includes an outer traction surface adapted for rolling contact with the inner surface of the outer vessel. The rotational processor also comprises a plurality of drive rollers and a drive system supporting the drive rollers. Each of the drive rollers is located between an adjacently located pair of the inner vessels. The drive system is adapted to drive the drive rollers such that the inner vessels are driven about a center line of the outer vessel in rolling contact with the inner surface of the outer vessel.

The drive system supports the drive rollers such that each of the drive rollers is capable of contacting each of the adjacently located pair of the inner vessels when the inner vessels are not being driven about the center line of the outer vessel. The outer traction surfaces of the inner vessels are adapted for compression in response to centrifugal forces applied to the outer traction surface when the inner vessels are being driven about the center line of the outer vessel. The compression of the outer traction surfaces of the inner vessels causes separation between each of the drive rollers and one of the adjacently located pair of the inner vessels such that each of the inner vessels is driven about the center line of the outer vessel by only one of the drive rollers.

According to one aspect of the invention, a rotational processor includes an outer vessel defining an inner cylindrical surface, a pair of inner vessels, and a drive system including a pair of drive rollers. Each of the inner vessels includes a base portion defining an interior for receipt of a processing container and at least one traction member supported by the base portion and defining an outer surface adapted for rolling contact with the inner cylindrical surface of the outer vessel. Each of the drive rollers of the drive system is supported at a radial distance from a drive axis for rotation about the drive axis by the drive system. The rotation of the drive rollers about the drive axis driving the inner vessels about a center line of the outer vessel.

The drive system supports the pair of drive rollers such that each of the drive rollers contacts each of the inner vessels when the inner vessels are not being driven about the center line of the outer vessel. The traction member of each of the inner vessels is adapted for compression in response to centrifugal forces applied to the traction member when the inner vessels are being driven about the center line of the outer vessel. The compression of the traction members causes separation between each of the drive rollers and one of the inner vessels such that each of the inner vessels is driven about the center line of the outer vessel by only one of the drive rollers.

The foregoing and other features of the invention and advantages of the present invention will become more apparent in light of the following detailed description of the exemplary embodiments, as illustrated in the accompanying figures. As will be realized, the invention is capable of modifications in various respects, all without departing from the invention. Accordingly, the drawings and the description are to be regarded as illustrative in nature, and not as restrictive.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown. The drawings are not necessarily to scale, emphasis instead being placed on illustrating the principles of the present invention.

DETAILED DESCRIPTION OF THE DRAWINGS

Figure 1:
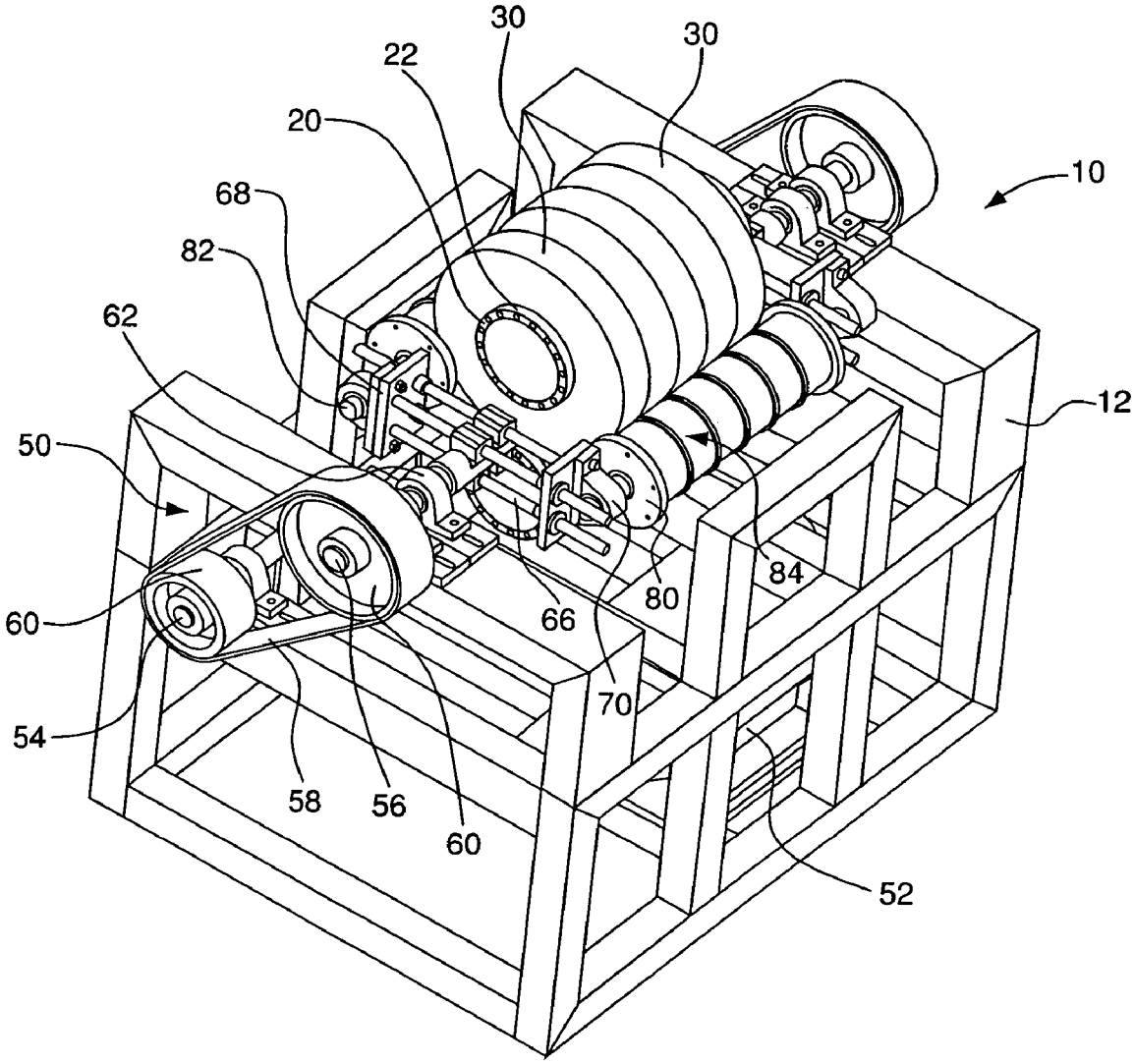
FIG. 1 is an isometric view of a rotational processor according to an exemplary embodiment of the present invention.

Referring now to the figures in which like reference numerals identify similar items throughout the views, an exemplary embodiment of the invention is shown.

FIG. 1 is an isometric view of a rotational processor 10 according to an exemplary embodiment of the present invention. (The outer vessel is not shown in FIG. 1.) The rotational processor 10 includes certain components and features that are similar to the rotational processors described in U.S. Pat. Nos. 6,733,375, 5,848,929, and 5,355,638, which are all incorporated herein by reference in their entirety. As such, details on the various components will not be described herein.

Figure 2:
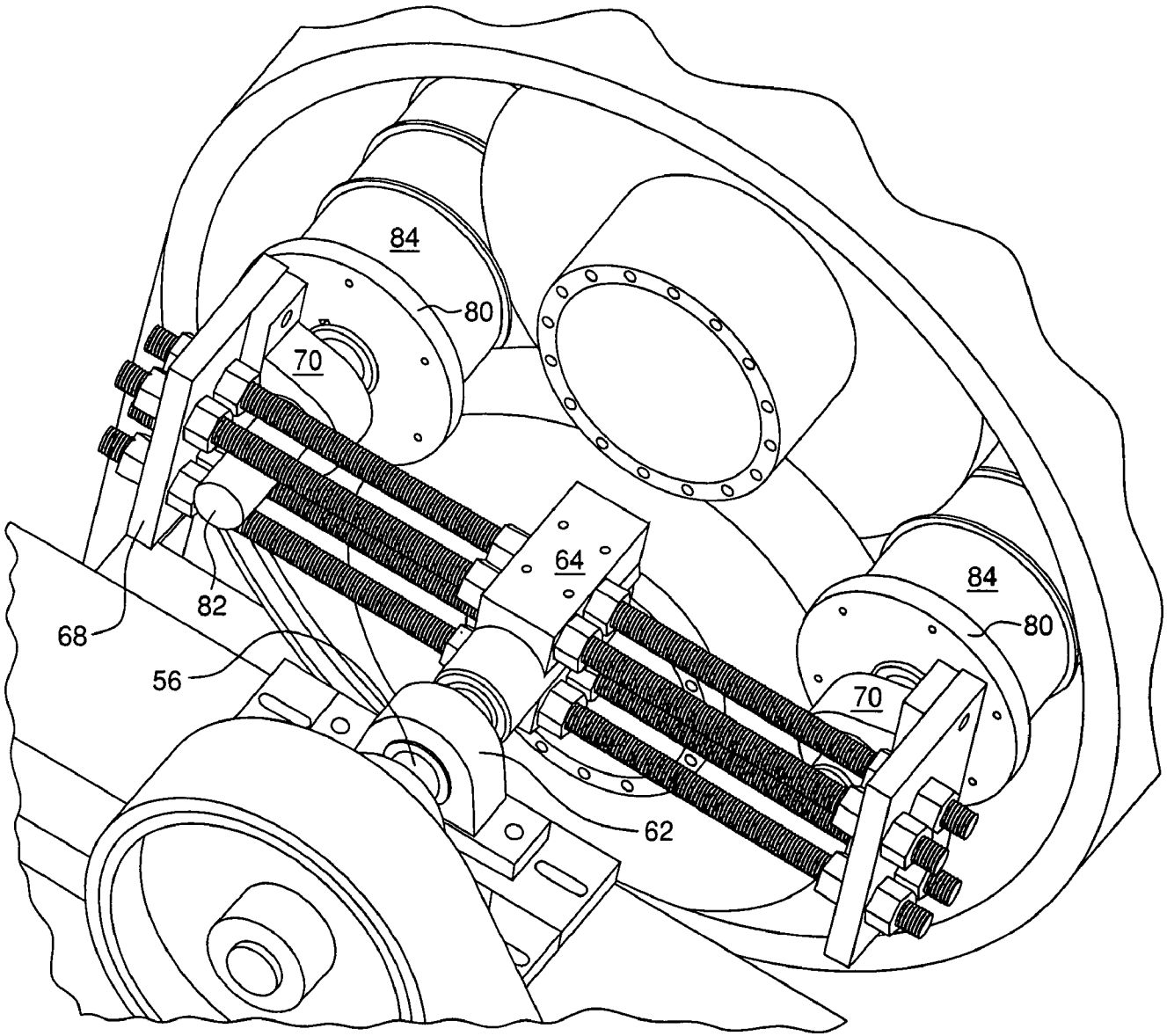
FIG. 2 is an enlarged view of a portion of the rotational processor of FIG. 1.
Figure 3:
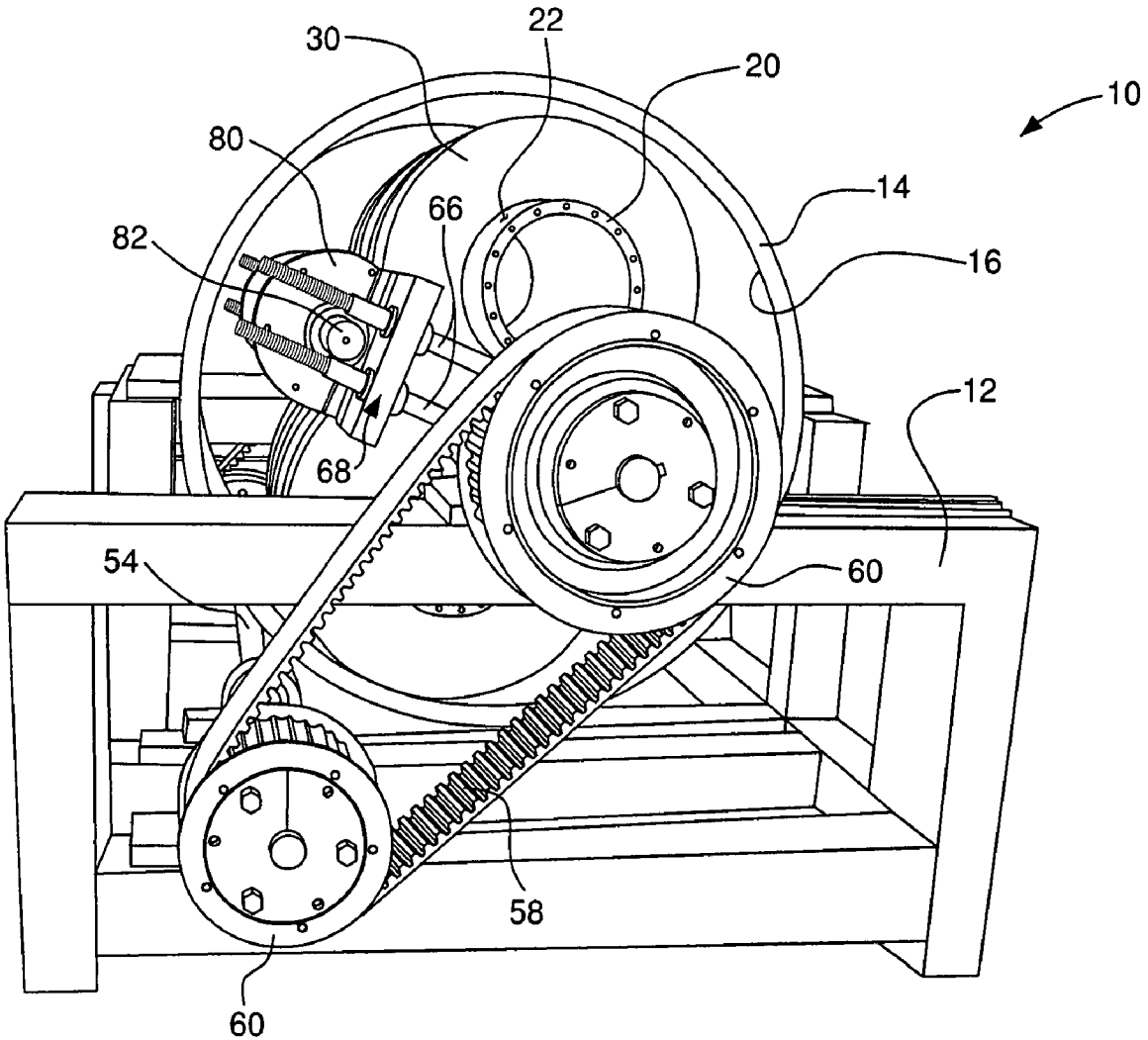
FIG. 3 is a side view of the rotational processor of FIG. 1.

Referring to FIGS. 1–3, the rotational processor 10 includes a frame 12 which supports an outer vessel 14 (shown in FIGS. 2 and 3), which preferably has a cylindrical inner surface 16. The outer vessel 14 is preferably fixed to the frame 12. However, it is also contemplated that the outer vessel 14 may be rotatable relative to the frame 12 as described in the above referenced issued patents.

There are preferably at least two inner vessels 20 located within the outer vessel 14. Each of the inner vessels 20 includes an outer surface 22 on which a traction surface (material) 30 is attached. The traction surface 30 is positioned so as to contact the inner surface 16 of the outer vessel 14 during operation. In the illustrated embodiment, there are multiple traction surfaces 30 formed on each inner vessel 20. Preferably, the traction surfaces 30 are spaced apart from one another along the length of the inner vessel 20 so as to provide multiple contact points between each of the inner vessels 20 and the outer vessel 14, while distributing the operational loads long the vessels 14, 20. The traction surface 30 can be made from any suitable material, such as those described in the issued patents noted above, and provides a resilient frictional interface between the inner vessel 20 and the inner surface 16 of the outer vessel 14. In one embodiment the traction surface is a urethane or rubber layer of material.

Although each of the traction surfaces 30 is depicted as a large ring of material extending radially outward from the outer surface 22 of the inner vessel 20, it should be readily apparent that the traction surface 30 could be radially thinner. For example, an annular ring of traction material with a thickness of one inch could be used. However, in order to locate the inner vessel 20 at the desired location relative to the outer vessel 14 (e.g. for contact with the inner vessel 20), a flange could be included to extend radially outward from the outer surface 22 of the inner vessel 20 between the inner vessel 20 and the traction surface 30.

The inner vessel 20 is tubular with an interior designed to accept a processing container (not shown) or, alternately, the products being processed can be directly placed in the inner vessel 20 (when suitable configured) such that the inner vessel functions also as a processing vessel. While the illustrated embodiment includes a cylindrical vessel, it is contemplated that the inner vessel 20 can be any desired shape. Furthermore, if the present invention is configured as a horizontal processor as shown, then both ends of the inner vessel 20 are preferably open so as to accept a processing container in each end.

The processing container is preferably engaged with the inner vessel 20 such that the two rotate in combination. In one embodiment, the processing container is attached to one or more holes 24 in the inner vessel 20 using bolts. Other forms of attachment could be used.

In order to rotate the inner vessels 20 along the inner surface 16 of the outer vessel 14, the present invention includes a drive system 50. The drive system 50 includes a motor 52 engaged to a first drive shaft 54 such that the motor 52 rotates the first drive shaft 54 about its axis. The first drive shaft 54 is mounted to the frame 12 through the use of one or more bearings. The first drive shaft 54 is engaged with a second drive shaft 56, preferably through a belt 58 and pulley 60 system. In the illustrated embodiment, there are two second drive shafts 56 located on opposite sides of the frame 12. Each second drive shaft 56 is attached to the first drive shaft 54 through its own belt and pulley arrangement. Each of the second drive shafts 56 is mounted to the frame 12 through the use of one or more bearings 62.

A mounting fixture 64 is attached to an end of the second drive shaft 56. One or more arms 66 extend laterally from opposite sides of the mounting fixture 64. In the illustrated embodiment, there are four arms 66 extending laterally from opposite sides of the mounting fixture 64. A support plate 68 is attached to each set of arms 66 near the radially distal end of the arms 66. In one preferred embodiment, the arms 66 are threaded along at least a portion of their length so as to permit radial adjustment of the support plate 68.

Support bearings 70 are mounted to each plate 68. Each support bearing 70 rotatably supports a drive roller 80. More particularly, the drive roller 80 includes a shaft 82 that extends though and is supported by the support bearing 70. The drive roller 80 includes an outer drive surface 84 that is designed to contact the inner vessel 20 or, more preferably, the outer surface of the traction surface 30. As shown in FIG. 1, the outer drive surface 84 may include a contour with a recess configured to receive the traction surface 30 so as to provide consistent engagement and parallel orientation between the drive roller 80 and the inner vessel 20.

Figure 4A:
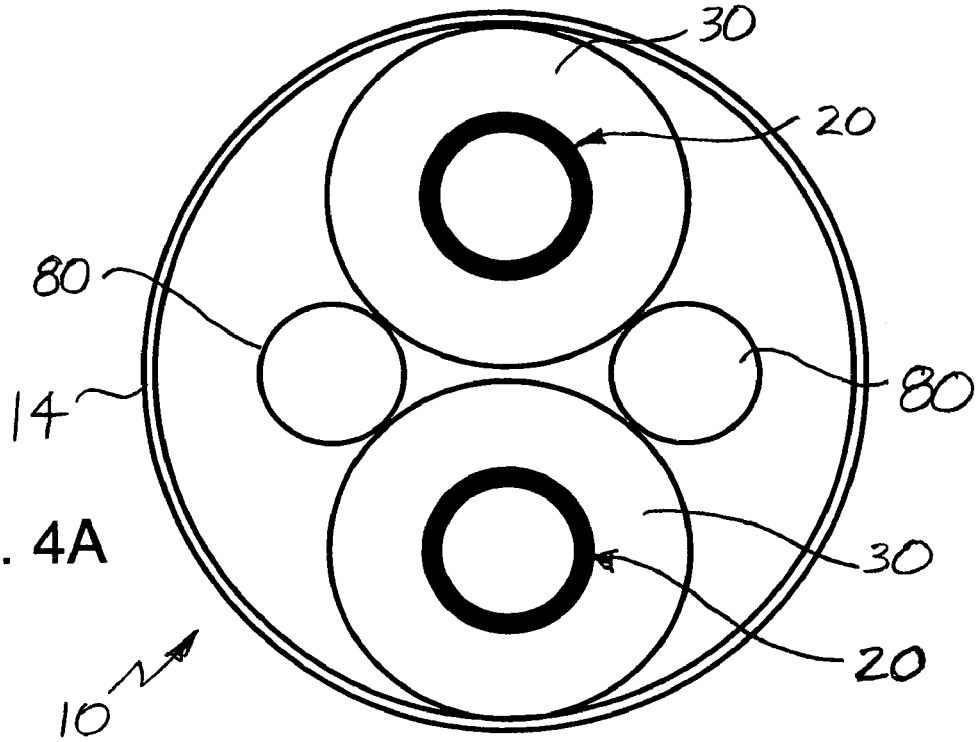
FIGS. 4A and 4B are end schematic views of the outer vessel, inner vessels and drive rollers of a rotational processor of the present invention respectively showing the processor in a non-operating condition and an operating condition.
Figure 4B:
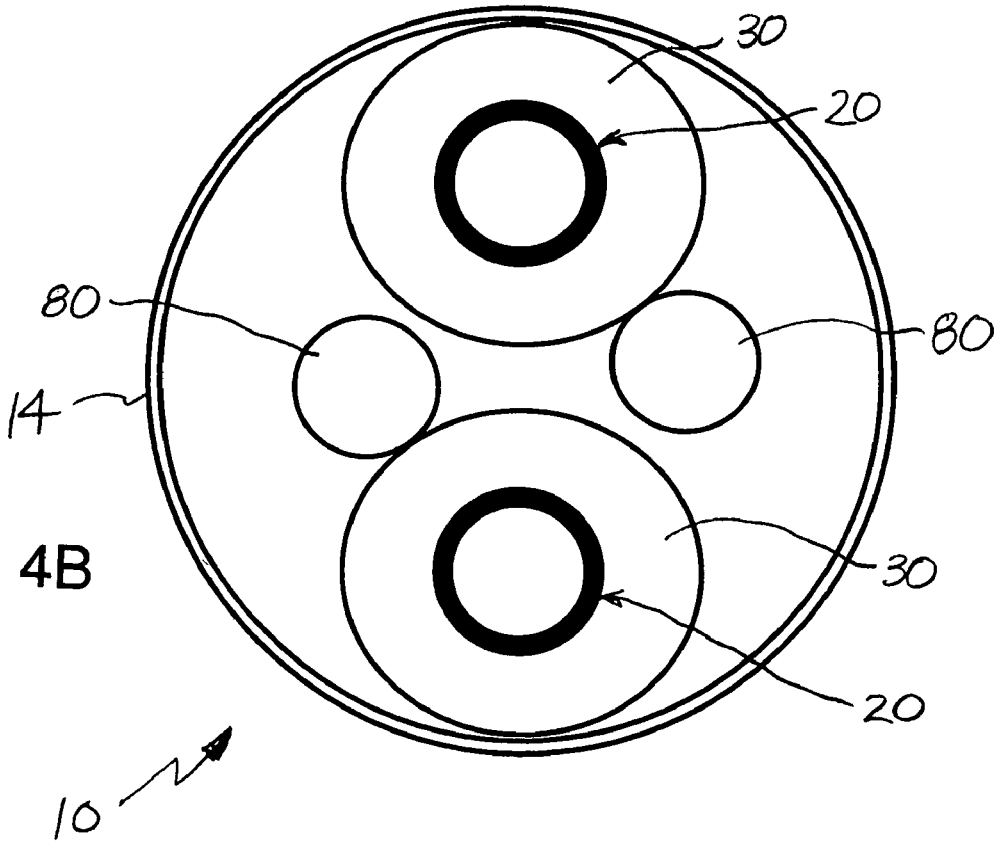

Referring to FIGS. 4A and 4B, the operation of the rotational processor 10 is illustrated schematically. In FIG. 4A, the processor 10 is shown in a resting condition (i.e., while not in operation). Each of the drive rollers 80 are preferably positioned between adjacent inner vessels 20. As shown, the outer surface 84 of each drive roller 80 contacts both of the inner vessels 20, or more preferably the traction surfaces 30 on both inner vessels 20, when the processor is not in operation. The above-described arms 66 are preferably adjusted so that the drive rollers 80 (one on either side in the illustrated embodiment) urge the traction surfaces 30 of the inner vessels 20 into contact with the inner surface 16 of the outer vessel 14. As such, the inner vessels 20 are set for immediate rotation upon activation of the processor.

Referring to FIG. 4B, the rotational processor 10 is shown during operation. Centrifugal loading will be applied to the traction surfaces 30 of the inner vessels 20 as the inner vessels are driven about the center line of the outer vessel 14 by the drive rollers 80 during operation of the processor 10. This centrifugal loading will result in a small amount of compression of the traction surfaces 30 and, as shown (greatly exaggerated in FIG. 4B), separation between the traction surfaces 30 of each of the inner vessels 20 and one of the drive rollers 80. As such, only one drive roller 80 would, in many cases, be contacting the traction surfaces 30 of each inner vessel 20 as it is driving the inner vessel 20 around the center line of the outer vessel 14.

There are slight variations between certain elements of the rotational processor 10 shown in each of FIGS. 1–3. However, the operation of the various elements of each is similar and, therefore, like reference numbers have been used throughout the figures. In particular, it is noted that the belt 58 and pulleys 60 of FIG. 3 include teeth and notches to facilitate engagement therebetween.

While the drawings and the above discussion have referred to the traction surface as being formed on the outer surface of the inner vessels, it should be readily apparent that the traction surface could be formed on the inside surface of the outer vessel. In this alternate embodiment, it may be desirable to also put a traction surface on the drive rollers. Also, while the traction surface has been described as a rubber or urethane, it should be readily apparent that any surface that provides sufficient friction to permit rolling contact could be used.

The present invention may be embodied in other specific forms without departing from the spirit or essential attributes thereof. Although the invention has been described and illustrated with respect to the exemplary embodiment thereof, it should be understood by those skilled in the art that the foregoing and various other changes, omissions and additions may be made therein and thereto, without parting from the spirit and scope of the present invention.

What is claimed is:

1. A rotational processor comprising:

an outer vessel defining an inner surface and have a central axis;

a plurality of inner vessels each defining an interior for receiving a processing container or a component to be processed, each of the inner vessels having its own central axis, each inner vessel adapted to roll along the inner surface of the outer vessel;

a traction surface located between the outer surface of the inner vessel and the inner surface of the outer vessel the traction surface facilitating the rolling of the inner vessel along the inner surface of the outer vessel;

a plurality of drive rollers each located between an adjacently located pair of the inner vessels; and a drive system supporting each of the drive rollers and adapted to drive the drive rollers such that the inner vessels are driven about a center line of the outer vessel in rolling contact with the inner surface of the outer vessel, the drive system supporting the drive rollers such that each of the drive rollers contacts each of the adjacently located pair of the inner vessels when the inner vessels are not being driven about the center line of the outer vessel, each drive roller adapted to drive at least one inner vessel about the central axis of the outer vessel while causing the inner vessel through its contact with the outer vessel to rotate about its own axis.

2. The rotational processor according to claim 1, wherein there is a traction surface located on the outer surface of each of the inner vessels and wherein the traction surfaces of the inner vessels are adapted to compress in response to centrifugal forces applied to the traction surface when the inner vessels are being driven about the central axis of the outer vessel, the compression of the traction surfaces of the inner vessels causing separation between each of the drive rollers and one of the adjacently located pair of the inner vessels such that each of the inner vessels is driven about the center line of the outer vessel by only one of the drive rollers.

3. The rotational processor according to claim 2, wherein the plurality of inner vessels includes two inner vessels and wherein the plurality of drive rollers includes two drive rollers.

4. The rotational processor according to claim 2, wherein each of the inner vessels includes a cylinder and wherein the outer traction surface is defined by an annular ring supported by the cylinder.

5. The rotational processor according to claim 4, wherein each of the inner vessels includes a plurality of annular rings supported by the cylinder each defining an outer traction surface, the annular rings spaced apart from one another along a length of the cylinder.

6. The rotational processor according to claim 2 further comprising a frame supporting the outer vessel, the outer vessel fixed to the frame.

7. The rotational processor according to claim 2, wherein the center line of the outer vessel is substantially horizontal.

8. The rotational processor according to claim 2, wherein the drive system rotatably supports each of the drive rollers for rotation of the drive roller about a central axis of the drive roller, and wherein the drive system supports each of the drive rollers at a radial distance from a drive axis, the drive system adapted to rotate the drive rollers about the drive axis.

9. The rotational processor according to claim 8, wherein the drive system includes a first assembly engaging each of the drive rollers at a first end of the drive rollers and a second assembly engaging each of the drive rollers at an opposite second end of the drive rollers, each of the first and second assemblies including a plurality of bearings each receiving a shaft of one of the drive rollers for rotation of the drive roller about the central axis of the drive roller, each of the first and second assemblies including a mounting fixture located at the drive axis and at least one support arm coupled between the mounting fixture and each of the bearings.

10. The rotational processor according to claim 9, wherein each support arm of each of the first and second assemblies of the drive system includes a threaded portion to provide for adjustment of the radial distance for each of the drive rollers.

11. The rotational processor according to claim 9, wherein each bearing of the first and second assemblies of the drive system is secured to a support plate, the support plate secured to the at least one support arm coupled between the mounting fixture and the bearing.

12. The rotational processor according to claim 9, wherein the mounting fixture of each of the first and second assemblies of the drive system is mounted on a drive shaft of the drive system.

13. A rotational processor comprising:

an outer vessel defining an inner cylindrical surface;

a pair of inner vessels each including a base portion defining an interior for receipt of a processing container and at least one traction member supported by the base portion and defining an outer surface adapted for rolling contact with the inner cylindrical surface of the outer vessel; and a drive system including a pair of drive rollers each supported at a radial distance from a drive axis for rotation about the drive axis by the drive system, the rotation of the drive rollers about the drive axis driving the inner vessels about a center line of the outer vessel, the drive system supporting the pair of drive rollers such that each of the drive rollers contacts each of the inner vessels when the inner vessels are not being driven about the center line of the outer vessel, the at least one traction member of each of the inner vessels adapted to compress in response to centrifugal forces applied to the traction member when the inner vessels are being driven about the central axis of the outer vessel, the compression of the traction members causing separation between each of the drive rollers and one of the inner vessels such that each of the inner vessels is driven about the center line of the outer vessel by only one of the drive rollers.

14. The rotational processor according to claim 13, wherein the at least one traction member of each of the inner vessels comprises a plurality of annular rings spaced apart from each other along a length of the base portion of the inner vessel.

15. The rotational processor according to claim 13, wherein the base portion of each of the inner vessels comprises a cylinder.

16. The rotational processor according to claim 13, wherein the at least one traction member of each of the inner vessels comprises rubber.

* * * * *